United States Patent [19]

Masuda

[11] 3,985,524

[45] Oct. 12, 1976

[54] ELECTRIC DUST COLLECTOR APPARATUS

[76] Inventor: Senichi Masuda, 40-10-605, 1-chome, Nishigahara, Kita, Tokyo, Japan

[22] Filed: Jan. 2, 1975

[21] Appl. No.: 538,093

[30] Foreign Application Priority Data

Jan. 4, 1974 Japan ..... 49-791

[52] U.S. Cl. ..... 55/112; 55/137; 55/138; 55/139; 55/152; 55/154

[51] Int. Cl.[2] ..... B03C 3/76

[58] Field of Search ..... 55/128–130, 55/136–139, 151, 152, 154, 157, 112

[56] References Cited

UNITED STATES PATENTS

| | | | |
|---|---|---|---|
| 2,704,134 | 3/1955 | White | 55/139 |
| 3,113,852 | 12/1963 | Steuernagel | 55/112 |
| 3,191,630 | 6/1965 | Demyan | 55/128 |
| 3,518,462 | 6/1970 | Brown | 55/136 |
| 3,803,808 | 4/1974 | Shibuya et al. | 55/128 |

FOREIGN PATENTS OR APPLICATIONS

| | | | |
|---|---|---|---|
| 859,870 | 1/1961 | United Kingdom | 55/130 |

*Primary Examiner*—Bernard Nozick
*Attorney, Agent, or Firm*—Price, Heneveld, Huizenga & Cooper

[57] ABSTRACT

An electric dust collector apparatus is disclosed herein; which comprises an inlet port for dust-containing gas, a main body duct of said electric dust collector, an outlet port for clean gas, and an exhaust port for collected dust; a plurality of channel-shaped collector electrodes disposed at an equal interval and in parallel to each other along a plane transverse of a gas flow within the main body duct with their opening directed to an upstream side; a plurality of channel-shaped driver electrodes disposed upstream of said collector electrodes at an equal interval, along a plane transverse of the gas flow within the main body duct in a staggered relationship to said respective collector electrodes, in parallel to each other and to said collector electrodes and as insulated from said collector electrodes with their openings directed to a downstream side; a plurality of corona discharge electrodes disposed midway between adjacent ones of said driver electrodes in parallel thereto and opposed to inner surfaces of the openings of said collector electrodes in parallel thereto, as insulated from both said driver and collector electrodes; a D.C. high voltage source for applying a D.C. high voltage between said driver electrodes and said collector electrodes; a variable D.C. high voltage source for applying a D.C. high voltage having a variable voltage value between said corona discharge electrodes and said driver electrodes, and/or a variable, periodically varying, high voltage source for applying a periodically varying high voltage, whose peak value and/or period are variable, between said corona discharge electrodes and said driver electrodes; and hammering means for applying mechanical impacts to said collector electrodes, driver electrodes and corona discharge electrodes.

11 Claims, 22 Drawing Figures

ELECTRIC DUST COLLECTOR APPARATUS

Figure 1A:
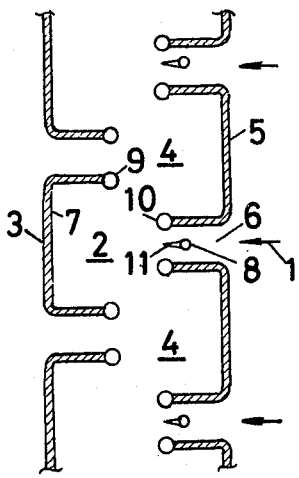
Figure 1B:
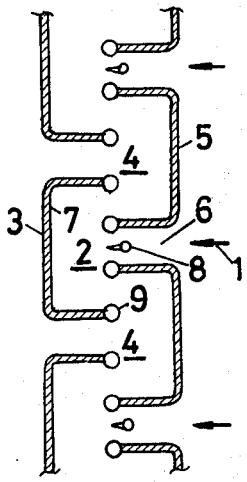
Figure 1C:
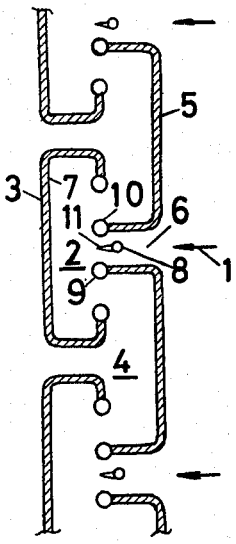
Figure 1D:
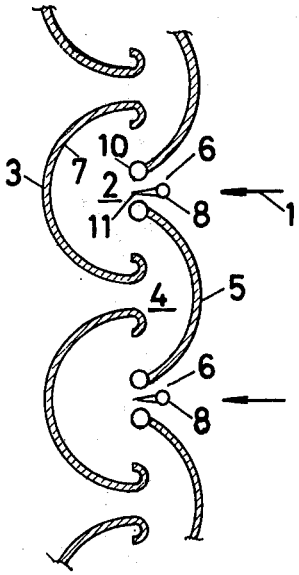
Figure 1E:
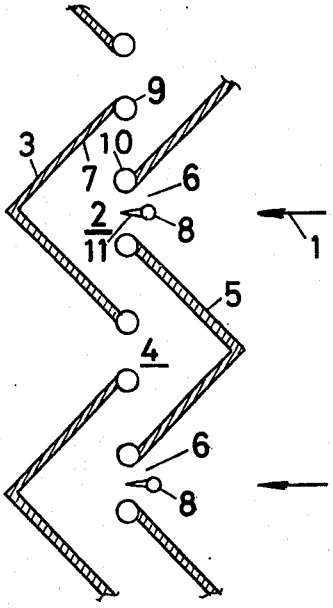
Figure 2A:
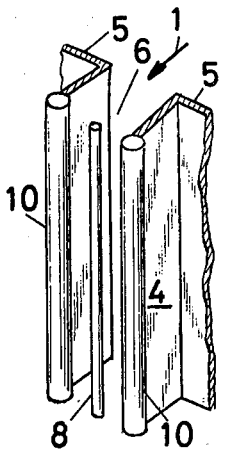
Figure 2B:
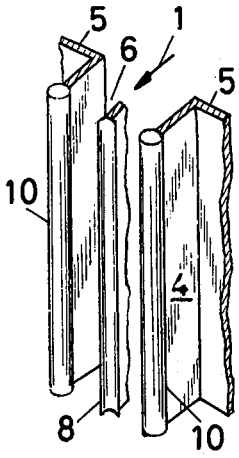
Figure 2C:
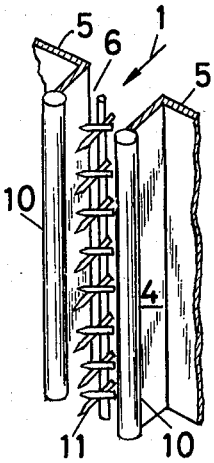
Figure 2D:
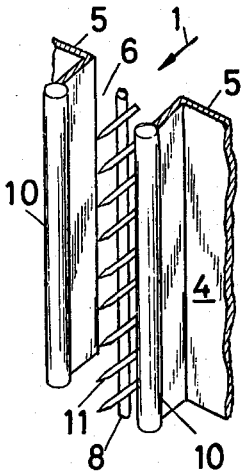
Figure 2E:
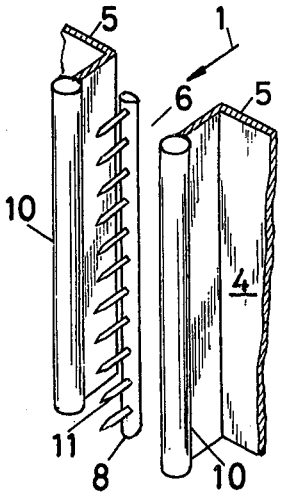
Figure 2F:
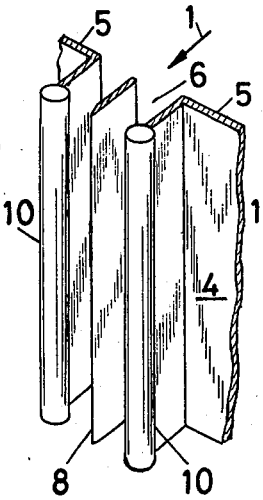
Figure 2G:
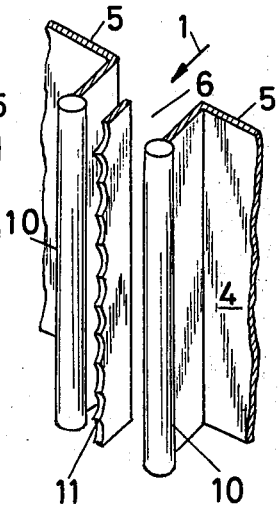
Figure 3A:
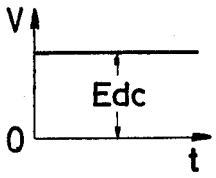
Figure 3B:
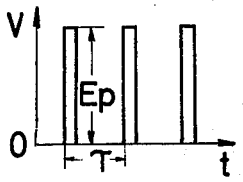
Figure 3C:
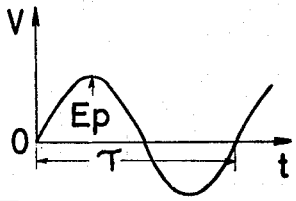
Figure 3D:
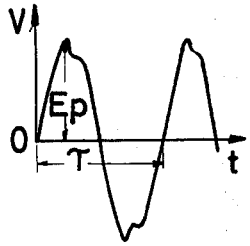
Figure 3E:
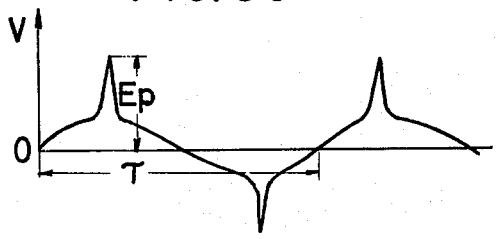
Figure 3F:
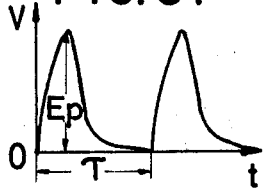
Figure 3G:
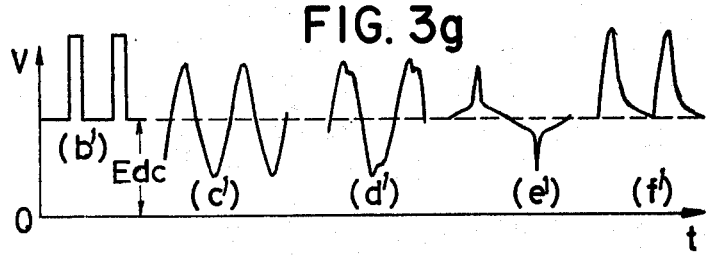

The present invention relates to an electric dust collector apparatus which is free from the shortcomings of both inverse ionization and dust re-spattering, and also which has an extremely compact and economical structure.

Generally, an electric dust collector apparatus is accompanied with two serious troubles, which are considered as great disadvantages restricting the performance of the electric dust collector apparatus; said two troubles being that (1) if a specific electric resistance $\rho d$ of the dust to be collected becomes higher than $10^{11}$ $\Omega$·cm, then an electric field strength E$d$ (= a current density within the dust layer $id \times \rho d$) within the dust layer accummulated on a dust collector electrode would exceed a breakdown value Eds of the electric field, so that breakdown occurs here, an intense spark discharge is generated, and neutralization of the dust charge due to the ions of opposite polarity which have been produced here occurs, resulting in wide lowering of the dust collecting performance; and that (2) upon hammering the dust collector electrodes, some of the dust accumulated on their surface would be spattered into a gas flow. The trouble (1) above is called an inverse ionization phenomenon, and the trouble (2) above is called a re-spattering phenomenon.

As one solution for the re-spattering phenomenon among the two serious troubles above, a two-stage type of electric dust collector comprising a charging section and a collecting section for carrying out charging and collection of dust in separate independent spaces, in the collecting section of which a plurality of channel-shaped driver electrodes and a plurality of channel-shaped collector electrodes are disposed transversely of a gas flow so that their respective openings may be opposed to each other, and a D.C. power source for applying a D.C. voltage is connected between said respective electrodes, has been publicly known.

Although the above-reference known apparatus can prevent lowering of an efficiency caused by the re-spattering phenomenon to a certain extent owing to the above-described structure of collector electrodes, the other trouble, that is, the inverse ionization phenomenon has not been overcome because of the use of the conventional type of D.C. corona discharge in the charging section, and so the lowering of the dust collecting efficiency caused by insufficient charging could not be avoided.

It is a general object of the present invention to provide an electric dust collector apparatus which can overcome both the shortcomings (1) and (2) above and which has a very excellent performance and a compact and economical structure by making use of effects of hydrodynamics.

A first specific object of the invention is to control a mono-polar ion current flowing from a corona discharge electrode to a collector electrode at such value that an inverse ionization phenomenon would never occur regardless of a specific electric resistance of dust independently of an electric field between a driver electrode and a collector electrode while maintaining said electric field at a maximum threshold value just lower than the value for generating a spark, and thereby to give a maximum amount of charge to the dust for exerting a maximum Coulomb's force for collection upon dust particles for driving them towards the interior of the collector electrode channel.

A second specific object of the invention is to exert upon dust particles a hydrodynamic force for converging them towards the interior of the collector electrode channel by making use of a contracted flow of the dust-containing gas generated upon passing through a gap space between driver electrodes, and thereby to collect the dust particles in the interior of the collector electrode channel in a very effective manner as a result of the cooperative effect of the electric force and the hydrodynamic converging action.

A third specific object of the invention is to make an electric adhesive force very effectively exert upon the dust layer formed by accumulation of the dust particles which have been once collected within the collector electrode channel, by making an ion current having a sufficient current density for effectively exerting an electric adhesive force within the limit for not generating an inverse ionization effect flow through the dust layer, and thereby to cause the dust layer to be continuously and strongly held on the inner surface of the channel and thus to be grown without generating re-spattering of dust particles from the accumulated dust layer in any event.

A fourth specific object of the invention is to cause said grown dust layer to be effectively peeled off and fall downwards in the region within the channel protected from the gas flow without generating respattering of the dust particles by hammering the collector electrode.

According to one feature of the present invention, an electric dust collector apparatus comprises a gas inlet port for introducing dust-containing gas, a main body duct of the dust collector apparatus, a gas outlet port for discharging clean gas, and a dust exhaust port for exhausting collected dust; (a) a plurality of channel-shaped collector electrodes disposed at an equal interval and in parallel to each other along a plane transverse of a gas flow within said main body duct with their openings directed to an upstream side; (b) a plurality of channel-shaped driver electrodes disposed upstream of said collector electrodes at an equal interval along a plane transverse of the gas flow within the main body duct in a staggered relationship to said respective collector electrodes and as insulated from said collector electrodes with their openings directed to a downstream side; (c) a plurality of corona discharge electrodes disposed midway between adjacent ones of said driver electrodes in parallel thereto and opposed to inner surfaces of the openings of said collector electrodes in parallel thereto as insulated from both said driver and collector electrodes; (d) a D.C. high voltage source for applying a D.C. high voltage between said driver electrodes and said collector electrodes; (e) a variable D.C. high voltage source for applying a D.C. high voltage having a variable voltage value between said corona discharge electrodes and said driver electrodes, and/or a variable, periodically varying, high voltage source for applying a periodically varying high voltage whose peak value and/or period are variable, between said corona discharge electrodes and said driver electrodes; (f) and hammering means for applying mechanical impacts to said collector electrodes, driver electrodes and corona discharge electrodes.

Figure 4:
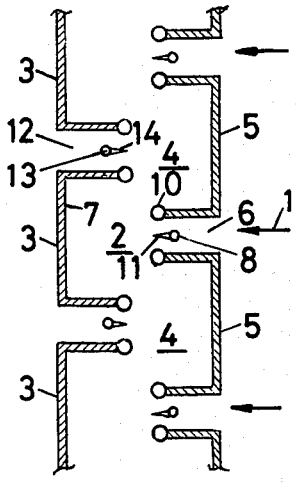
Figure 5:
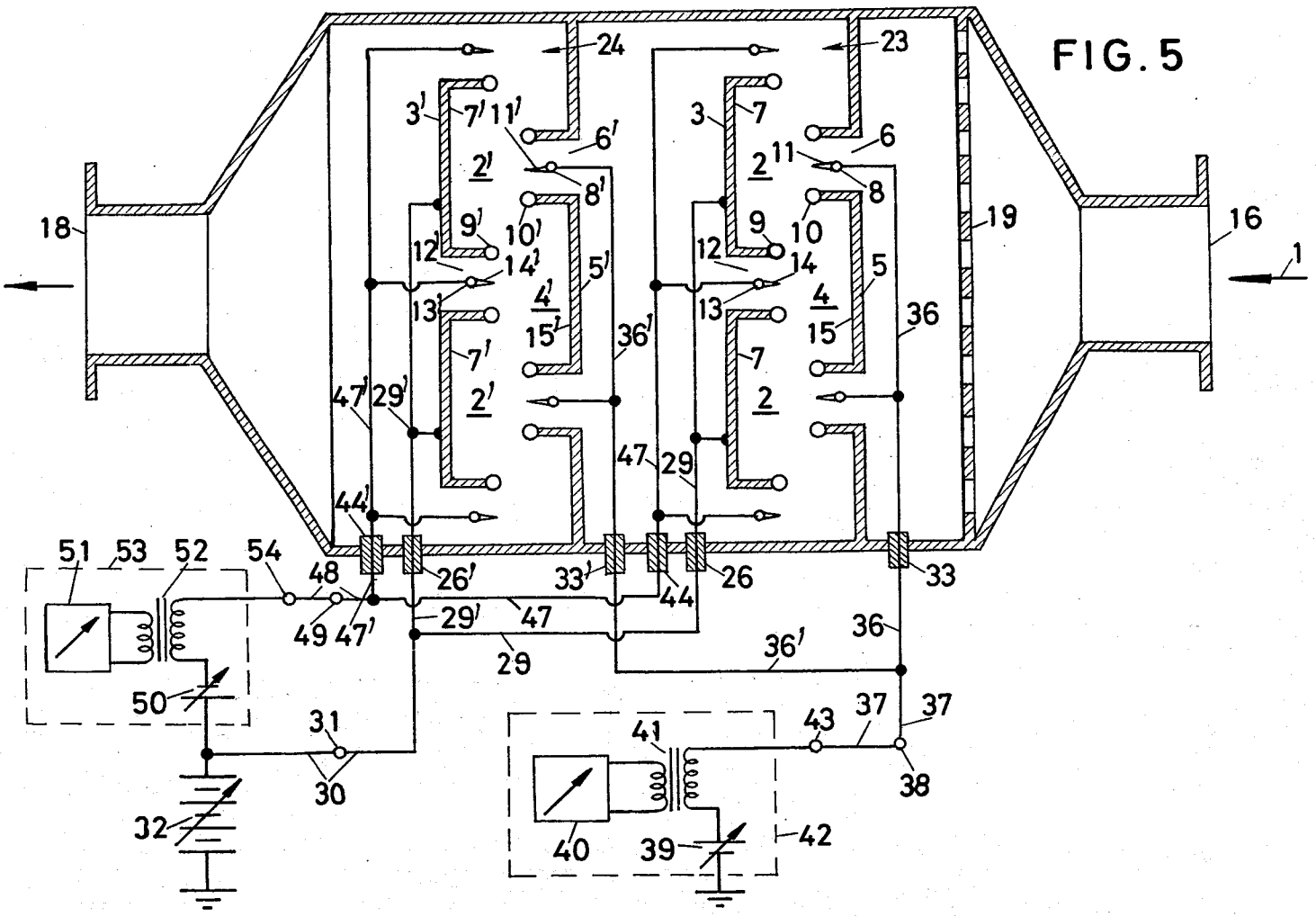
Figure 6:
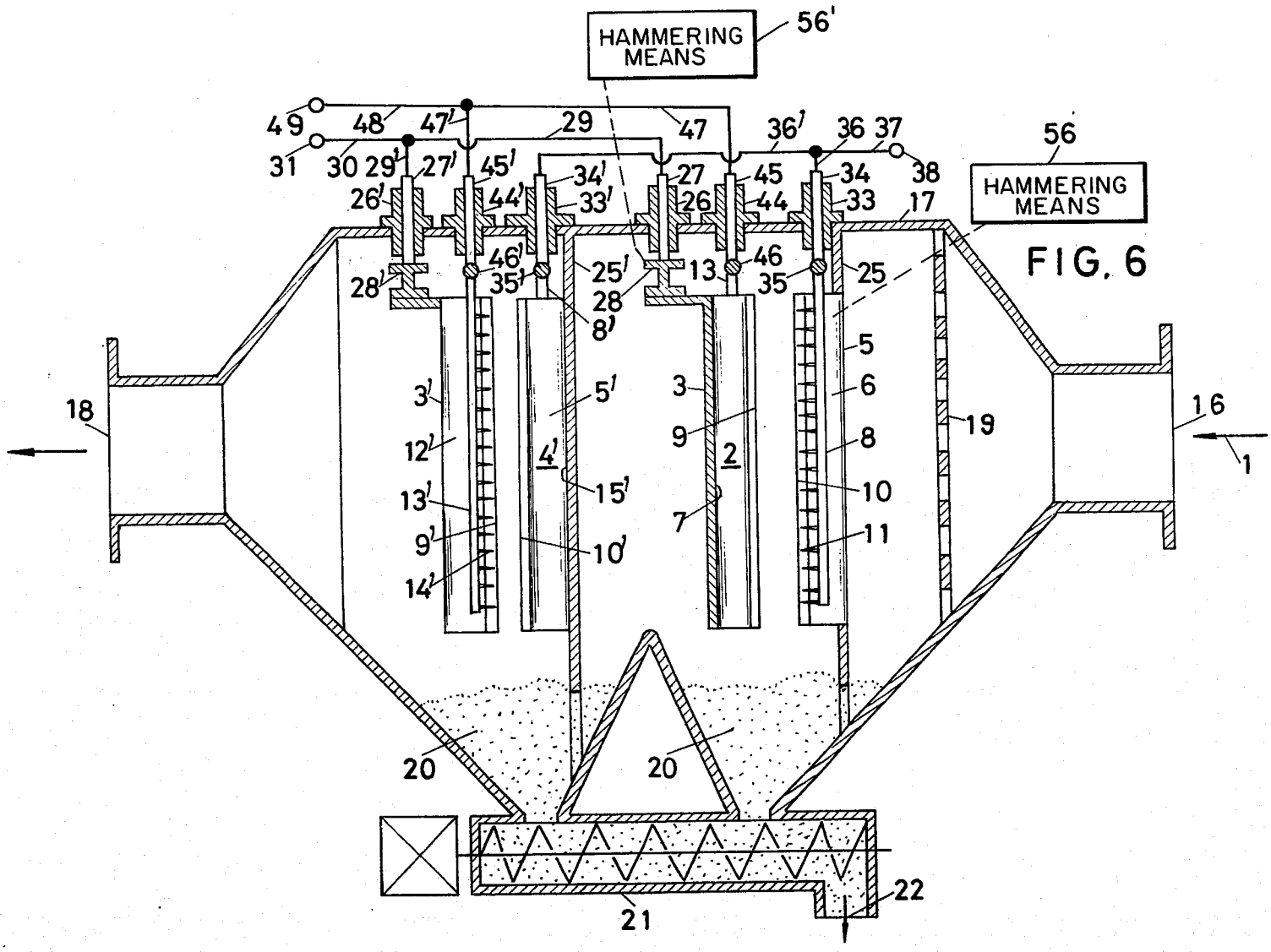

These and other features and objects of the present invention will be more fully understood by the following description of its preferred embodiments taken in conjunction with the accompanying drawings, in which:

FIGS. 1(*a*) through 1 (*e*) show examples of cross-section configurations and relative positioning of channel-shaped driver and collector electrodes and relative positioning of corona discharge electrodes, which form an essential feature of the present invention, FIGS. 2(*a*) through 2 (*g*) show examples of a structure and a configuration of the corona discharge electrode and its relative positioning which forms an essential feature of the present invention, FIGS. 3(*a*) through 3(*g*) show examples of a waveform of a variable D.C. high voltage and/or a variable, periodically varying high voltage to be applied between the corona discharge electrode and the driver electrode (or the collector electrode), FIG. 4 shows an example of electrode arrangement in which corona discharge electrodes are additionally disposed midway 12 between the collector electrodes 12, FIG. 5 is a horizontal cross-section view showing one preferred embodiment of the present invention, and FIG. 6 is a vertical cross-section view of the same embodiment.

As shown in FIGS. 1(*a*) – (*e*), the cross-section configuration of the channel-shaped collector electrodes and the channel-shaped driver electrodes could be a U-shape, V-shape, heart-shape, C-shape or any other shape. In these figures are shown a group of channel-shaped collector electrodes 3 disposed on a downstream side of a gas flow indicated by a arrow 1 with their openings 2 directed to an upstream side, a group of channel-shaped driver electrodes 5 disposed on the upstream side of the gas flow in a staggered relationship to the collector electrodes 3 with their openings 4 directed to a downstream side, and corona discharge electrodes 8 each of which is disposed midway 6 between adjacent driver electrodes 5 as opposed to an inner surface 7 of the collector electrode channel 3. In FIG. 1(*a*), the cross-section configurations of the collector electrodes 3 and the driver electrodes 4 are both U-shape, and at the respective edge portions of these electrodes are mounted cylinders 9 and 10 for preventing concentration of an electric field. In FIG. 1(*b*), while the cross-section configurations of the collector electrodes 3 and the driver electrodes 4 are exactly the same as those shown in FIG. 1(*a*), the distance between these respective electrodes are smaller than that shown in FIG. 1(*a*) with their projecting portions mutually interlaced. In FIG. 1(*c*), the cross-section configuration of the collector electrodes 3 is C-shape, while that of the driver electrodes 5 is U-shape. In FIG. 1(*d*), the cross-section configuration of the collector electrodes 3 is heart-shape, while that of the driver electrodes 5 is arcuated shape. In FIG. 1(*e*), the both electrodes have a V-shaped cross-section configuration.

In other words, the term "channel-shape" used herein implies a channel-like structure having any arbitrary cross-section configuration provided with an opening on one side as described above. It is to be noted that it is desirable for preventing a corona discharge from arising at the edge portions and thus for raising a spark voltage as high as possible to round the edge portions of the electrodes by any arbitrary method such as by providing the cylinders 9 and 10 as shown in FIG. 1 for preventing an electric field from being concentrated at the edge portions.

With regard to the corona discharge electrodes 8 which are characteristic of the present invention, they are disposed midway between adjacent driver electrodes 5 with their corona discharge portions 11 opposed to the inner surfaces 7 of the collector electrodes 3 as shown in FIGS. 1 and 2, and while their structure and configuration are shown in FIG. 1 as constructed of a plurality of corona discharge portions consisting of acicular protrusions provided at an equal interval on a cylinder, so long as they can achieve corona discharge towards the inner channel surfaces 7 of the collector electrodes 3 it is a matter of course that any structure and any configuration could be employed such as, for example, generally a wire shape (FIG. 2(*a*)), a rectangular wire shape, (FIG. 2(*b*)), a barbed wire shape (FIG. 2(*c*)), a wire provided with corona discharge portions 11 at an equal interval each consisting of an acicular protrusion (FIG. 2(*d*)), a cylinder provided with corona discharge portions at an equal interval each consisting of an acicular protrusion (FIG. 2(*e*)), a knife-edge shape (FIG. 2(*f*)), a metal strip having corona discharge portions 11 projected therefrom at an equal interval by cutting arcuated notches therein (FIG. 2(*g*)), etc., as shown in FIG. 2. However, in general the structures shown in FIGS. 2(*d*), (*e*) and (*g*) are favorable because equalization of a corona current can be realized.

These collector electrodes, driver electrodes and corona discharge electrodes are insulated from each other and disposed in parallel to each other. The direction of these parallel electrodes could be selected in any one of vertical, horizontal and oblique directions in the three-dimensional space, and could be selected in either perpendicular or oblique direction with respect to a gas flow. However, in general, it is favorable to select the direction in a vertical direction in the three-dimensional space and in a perpendicular direction with respect to a gas flow, because the structure of the dust collector apparatus becomes compact and economical.

With regard to the distance between the corona discharge electrode 8 and the driver electrode 4, though it is required to reduce the voltage applied between these electrodes by minimizing the distance within the scope for allowing stable corona discharge, it is desirable for stabilization to select the distance equal to 1 cm or more, in case of large scale apparatuses it is necessary to select the distance at about 3 – 5 cm in view of a machining accuracy, and in general it is favorable to select the distance in the range of 1 – 10 cm. In addition, generally it is favorable to dispose the corona discharge electrode 8 at such position that the tip end of the corona discharge portion 11 (a wire surface or knife-edge itself in case of a wire, rectangular wire, knife-edge, etc., and an acicular protrusion in case of an electrode provided with acicular protrusions) may be located on the same place as the edge portions 10 of the driver electrodes 5 or at a paosition somewhat retracted on the upstream side from said plane. Further, it is desirable to select the distance between the collector electrode 2 and the driver electrode 4 in such manner that the distance between the respective edge portions 9 and 10 may not largely differ from the distance between these edge portions and the respective channel inner surfaces and the distance may fall within the range of 1 – 100 cm.

The waveform of the high voltage to be applied between the corona discharge electrodes and the driver electrodes could be a D.C. voltage Edc as shown in FIG. 3(*a*), or else could be any arbitrary periodically varying waveform having a peak value Ep and a period $\tau$ such as, for example, a repetitive pulse waveform (FIG. 3(*b*)), an alternating sinusoidal waveform (FIG. 3(*c*)), an alternating distorted waveform having harmonic waves supperposed on a fundamental sinusoidal wave (FIGS. 3(*d*) and 3(*e*)), a pulsating waveform (FIG. 3(*f*)), waveforms consisting of a D.C. voltage superposed on the above-referred waveforms (FIG. 3(*g*): waveforms shown at (*b'*), (*c'*), (*d'*), (*e'*) and (*f'*) consisting of a D.C. voltage superposed on the waveforms shown in FIGS. 3(*b*), (*c*), (*d*), (*e*) and (*f*), respectively), etc. However, in order to prevent inverse ionization from arising locally by distributing an ion current over the inner channel surface of the collector electrode as uniformly as possible, it is favorable to use a waveform having a sharp peak in the proximity of the peak value point such as shown in FIGS. 3(*b*), 3(*e*), 3(*b'*) and 3(*e'*).

In some cases, a D.C. corona discharge can be generated even without applying a D.C. high voltage between said corona discharge electrodes and said driver electrodes, and so in such cases the above-referred variable D.C. high voltage source could be omitted.

Further, in some cases, midway 12 between the collector electrodes 3 provided on the downstream side are also disposed additional corona discharge electrodes 13 having any structure and any configuration as illustrated in FIGS. 2(*a*) – (*g*), at an equal interval and in parallel to each other and to the collector electrodes 3 and the driver electrodes 5 as insulated from the collector and driver electrodes, with their corona discharge portions 14 opposed to the inner surfaces of the driver electrode channels 5 on the upstream side, as shown in FIG. 4. Between these additional corona discharge electrodes 13 and the collector electrodes 3 are applied a D.C. high voltage and/or a periodically varying high voltage having any arbitrary waveform as shown in FIG. 3 to form a monopolar ion current (having an opposite polarity to the ion current flowing from the corona discharge electrodes 8) flowing towards the inner surfaces 15 of the driver electrodes 5, and thereby uncollected dust or eventually respattered dust can be recharged to be collected and deposited on the inner surfaces 15 of the driver electrode channels 5 by the D.C. electric field. Owing to the aforementioned provision, the performance of the dust collector apparatus according to the present invention can be further widely improved with a slight rise of cost, and thus it is favorable.

Also in the novel electric dust collector apparatus according to the present invention, the direction of hammering the driver electrodes and the collector electrodes could be perpendicular to the respective electrode channels, but in general it is more favorable to hammer the respective electrode channels in the same direction as their lengthwise direction because respattering is then reduced.

While the novel electric dust collector apparatus according to the present invention could be used in a dry type, it is a matter of course that the apparatus can be used in a wet type by forming water films on the surfaces (inner and outer surfaces) of the driver and collector electrodes through spraying or other appropriate methods.

Still further, in the novel electric dust collector apparatus according to the present invention, while one dust collecting stage can be formed of component elements consisting of driver electrodes, collector electrodes, corona discharge electrodes and, if desired, additional corona discharge electrodes on the downstream side (midway between the collector electrodes), the dust collecting stages could be disposed for use not only in a single stage but also in multiple stages along the direction of the gas flow, and it is a matter of course that the apparatus can be formed for use in a hybrid construction by constructing some stages on the upstream side in a dry type and the remaining stages on the downstream side in a wet type. In addition, the above-described dust collecting stage could be disposed downstream of a known horizontal type of electric dust collector, or else this dust collecting stage could be used as a dust collecting section of a two-stage type of electric dust collector. Also it is a matter of course that the collector electrodes, driver electrodes and corona discharge electrodes could be constructed not only of metal but also of any arbitrary materials having a nature of conductor or sem-coductor such as, for exammple, conductive plastic material and the like.

Now the characteristic feature and construction of the novel electric dust collector apparatus according to the present invention will be described in more detail in connection to its preferred embodiment with reference to the accompanying drawings.

FIG. 5 is a horizontal cross-section view of a preferred embodiment of the present invention as practiced in a dry multi-stage type of construction, and FIG. 6 is a vertical cross-section view of the same. In these figures, reference numeral 16 designates an inlet port for dust-containing gas, numeral 17 designates a main body duct of the dust collector, apparatus, numeral 18 designates an outlet port for clean gas, numeral 19 designates a porous plate for equalizing the gas flow distribution, numeral 20 designates a dust collecting hopper, numeral 21 designates a dusut exhausting device and numeral 22 designates an exhaust port for dust. In addition, reference numeral 23 designates a dust collecting stage disposed on the upstream side within the main body duct 17, and reference numeral 24 designates a dust collecting stage disposed on the downstream side within the main body duct 17. Each of said dust collecting stages consists of (a) channel-shaped collector electrodes 3 or 3' having a U-shaped cross-section and cylinders 9 or 9' provided at their edge portions, disposed on the downstream side in said stage at an equal interval transversely of and perpendicular to a gas flow, as directed vartically and in parallel to each other, with their openings 2 or 2' directed to the upstream side; (b) channel shaped driver electrodes 5 or 5' having a U-shaped cross-section and cylinders 10 or 10' provided at their edge portions, disposed on the upstream side of said collector electrodes in a staggered relationship and in parallel thereto at an equal distance therefrom, and at an equal interval transversely of and perpendicular to the gas flow, as directed vertically and in parallel to each other, with their openings 4 or 4' directed to the downstream side; (c) corona discharge electrodes 8 or 8' disposed midway 6 or 6' between adjacent ones of said driver electrodes 5 or 5' in parallel thereto and to said collector electrodes 3 or 3', each of said corona discharge electrodes 8 or 8' consisting of a vertical cylinder provided with corona discharge portions 11 or 11', which are formed of acicular protrusions fixedly secured to said cylinder at an equal interval as projecting therefrom and opposed to the inner surface 7 or 7′ of the channel of said collector electrode 3 or 3′; and (d) additional corona discharge electrodes 13 or 13′ disposed midway 12 or 12′ between adjacent ones of said collector electrodes 3 or 3′ in parallel thereto and to said driver electrodes 5 or 5′, each of said additional corona discharge electrodes 13 or 13′ consisting of a vertical cylinder provided with corona discharge portions 14 or 14′, which are formed of acicular protrusions fixedly secured to said cylinder at an equal interval as projecting therefrom and opposed to the inner surface 15 or 15′ of the channel of said driver electrode 5 or 5′. The driver electrodes 5 and 5′ are fixedly supported from the main body duct 17 via stanchions 25 and 25′, respectively, and they are grounded jointly with said main body duct 17. The collector electrodes 3 and 3′ are supported by horizontal beams 28 and 28′, respectively, which are in turn fixedly supported via stanchions 27 and 27′, respectively, that are insulatively supported by insulators 26 and 26′, respectively, and they are applied with a positive D.C. high voltage with respect to said grounded driver electrodes 5 and 5′ that is just lower than the voltage for generating spark discharge, by connecting them to a positive variable D.C. high voltage source 32 via a terminal 31 through conductors 29, 29′ and 30. The corona discharge electrodes 8 and 8′ are supported by horizontal rods 35 and 35′, respectively, which are in turn fixedly supported via stanchions 34 and 34′, respectively, that are insulatively supported by insulators 33 and 33′, respectively, and they are connected through conductors 36, 36′ and 37 and a terminal 38 to an output terminal 43 of a variable, periodically varying, high voltage source 42, which comprises a positive variable D.C. bias voltage source 39 and a pulse transformer 41 connected in series to the voltage source 39, said pulse transformer 41 being applied on its primary side with an output voltage of a voltage source 40 for generating a distorted alternating voltage whose peak value and/or period are variable as shown in FIG. 3(*e*), whereby the corona discharge electrodes 8 and 8′ may be applied with a periodically varying high voltage whose peak value and/or period are variable as shown at (*e*′) in FIG. 3(*g*). In addition, the additional corona discharge electrodes 13 and 13′ are supported by horizontal rod 46 and 46′, respectively, which are in turn fixedly supported via stanchions 45 and 45′, respectively, that are insulatively supported by insulators 44 and 44′, respectively, and they are connected through conductors 47, 47′ and 48 and a terminal 49 to an output terminal 54 of a variable, periodically varying, high voltage source 53, which is connected in series to an output side of the positive D.C. high voltae source 32, and which comprises a negative variable D.C. bias voltage source 50 and a pulse transformer 52 connected in series to the voltage source 50, said pulse transformer 52 being applied on its primary side with an output voltage of a voltage source 51 for generating a distorted alternating voltage whose peak value and/or period are variable as shown in FIG. 3(*e*), whereby the additional corona discharge electrodes 13 and 13′ may be applied with a periodically varying high voltage whose peak value and/or period are variable, having a waveform formed by inverting the waveform shown at (*e*′) in FIG. 3(*g*) with respect to the time axis (horizontal abscissa).

Consequently, between the driver electrodes 5 or 5′ and the collector electrodes 3 or 3′ are established strong electric fields, which have a field strength just lower than that for generating spark discharge, with the latter acting as positive electrodes and the former as negative electrodes, a repetitive pulse-shaped negative ion current caused by periodic impulsive negative corona discharge flows from said corona discharge electrodes 8 or 8′ towards the inner surfaces 7 or 7′ of the channels of said collector electrodes 3 or 3′, and a repetitive pulse-shaped positive ion current caused by periodic impulsive positive corona discharge flows from said additional corona discharge electrodes 13 or 13′ towards the inner surfaces 15 or 15′ of the channels of said driver electrodes 5 or 5′. Then, the magnitudes of these negative and positive ion currents can be controllably varied from zero to maximum values by controlling the voltage values of said D.C. bias voltage sources 39 and 50 and the output voltage peak values and frequencies of said distorted alternating voltage sources 40 and 51, and thereby the negative ion current density on said inner surfaces 7 and 7′ and the positive ion current density on said inner surfaces 15 and 15′ can be freely regulated.

In operation, dust-containing gas introduced into the main body duct 17 through the inlet port 16 passes, after having its flow velocity distribution equalized by the porous plate 19, through the midways 6 between the driver electrodes 5 in the dust collecting stage 23 on the upstream side, then is directed to the channel inner surfaces 7 of said collector electrodes 3 while being converged into contracted flows, and after the contracted flows been reversed at the inner surfaces 7 and have passed the neighborhood of the channel inner surfaces 15 of said driver electrodes 5, they proceed to the downstream side through the midways 12 between said collector electrodes 3 and are passed to the dust collecting stage 26 on the downstream side. During the aforementioned process, dust particles contained in the gas are subjected to collision with the repetitive impulsive ion current under the action of the strong electric field just lower than that for generating spark discharge in the way from said midway 6 towards said inner surface 7, and thereby negatively charged to a maximum extent, and these charged dust particles are very effectively driven to and deposited and accumulated on said inner surfaces 7 under the action of both the maximum Coulomb's force and the converging force caused by said contracted flow. A small fraction of dust particles then leaked away and respattered dust particles are now positively charged to a maximum extent, by the repetitive impulsive positive ion current, on the upstream side of said midways 12 under the action of the strong electric field just lower than that for generating spark discharge, and the recharged dust particles are very effectively collected, deposited and accumulated on said inner surfaces 15 under the action of the maximum Coulomb's force. In this case, since the above-mentioned negative ion current density as well as the positive ion current density can be freely controlled so that the relation of $id \times \rho d < Eds$ may be always maintained in the accumulated dust layer regardless of the specific electric resistance $\rho d$ of the dust, generation of the inverse ionization phenomenon can be completely prevented and the electric adhesive force can be effectively exerted upon the dust layer. Therefore, generation of respattering can be suppressed to minimum, and so the dust layer can be grown effectively. In addition, when said driver electrodes 5 and said collector electrodes 3 are hammered by hammering means 56, 56′, (FIG. 6) provided for applying mechanical impacts to at least the collector and driver electrodes; it is possible to make the dust layers fall along the channel inner surfaces 7 and 15, which are protected from the gas flow, into the hopper 20 under these electrodes without causing respattering at all. Since the operation and effect with respect to the dust collecting stage 24 on the downstream side are exactly the same, a further explanation thereof will be omitted here. In this way, the collection of dust can be achieved very effectively regardless of the nature of the dust, the cleaned gas is discharged through the outlet port 18 into a stack, and the dust collected in the hopper 20 is exhausted externally through the exhaust port 22 by means of the dust exhausting device 21.

In the above-described embodiment, an example of employing a repetitive impulsive ion current has been shown. Such an ion current especially results in unform distribution, so that even in case of high electric resistance of dust, inverse ionization due to local concentration of a current is not generated, and in this respect such an ion current is suitable for collecting dust having a high resistance. In addition, even in case that the dust particles are extremely fine, the contained dust concentration is high, and a current suppression effect (corona quenching effect) is remarkable, there exists an effect of capable of passing a sufficient ion current, and so an excellent dust collecting effect can be achieved. Therefore, the present invention is applicable to the case where minute particles are introduced at a high concentration. Whereas, in case of dust having a relatively low electric resistance, it is more preferable to apply a D.C. voltage to the corona discharge electrodes to cause an intense ion current to flow, and thereby to make an electric adhesive force reveal itself to a maximum extent.

What we claim is:

1. An electric dust collector apparatus comprising:

a body duct having gas inlet and outlet means;

a plurality of channel-shaped collector electrodes disposed in said body duct at equal intervals in parallel to each other along a plane transverse of a gas flow within said body duct, said channel-shaped collector electrodes having openings directed upstream;

a plurality of channel-shaped driver electrodes disposed in said body duct upstream of said collector electrodes at equal intervals along a plane transverse of the gas flow within said body duct and in staggered relationship to said respective collector electrodes, said driver electrodes positioned in parallel to each other and to said collector electrodes and insulated from said collector electrodes, said driver electrodes including openings directed to downstream;

a plurality of corona discharge electrodes disposed midway between adjacent ones of said driver electrodes in parallel thereto and opposed to inner surfaces of said collector electrodes in parallel thereto an insulated from both said driver and collector electrodes; and a D.C. high voltage source for applying a D.C. high voltage between said driver electrodes and said collector electrodes.

2. An electric dust collector apparatus as defined in claim 1 and further including a variable D.C. high voltage source and means for coupling said last named source to said corona discharge electrodes and to said driver electrodes for applying a D.C. high voltage having a variable voltage value between said corona discharge and driver electrodes.

3. An electric dust collector apparatus as defined in claim 1 and further including a variable, periodically varying, high voltage source for providing a periodically varying high voltage, whose peak amplitude is variable, and means for coupling said last named source to said corona discharge electrodes and said driver electrodes.

4. An electric dust collector apparatus as defined in claim 1 and further including a variable D.C. high voltage source having a variable voltage and a variable high voltage source for providing a periodically varying high voltage, whose peak amplitude is variable, coupled in series with said variable D.C. high voltage source and means coupling said corona discharge and driver electrodes to the series coupled sources.

5. An electric dust collector apparatus as claimed in claim 1, and further including a plurality of additional corona discharge electrodes disposed in said body duct midway between adjacent ones of said collector electrodes in parallel thereto and opposed to inner surfaces of the openings of said driver electrodes in parallel thereto and insulated from both said driver and collector electrodes and from said first corona discharge electrodes.

6. An electric dust collector apparatus as defined in claim 5 and further including a variable D.C. high voltage source coupled to said additional corona discharge electrodes and to said collector electrodes for applying a D.C. high voltage having a variable voltage value between said additional corona discharge and said collector electrodes.

7. An electric dust collector apparatus as defined in claim 5 and further including a variable, periodically varying high voltage source coupled to said additional corona discharge electrodes and said collector electrodes for applying a variable and periodically varying high voltage between said additional corona discharge and collector electrodes, and further including hammering means for applying mechanical impacts at least to said collector and driver electrodes.

8. An electric dust collector apparatus as claimed in claim 5 and further including a variable periodically varying high voltage source and a D.C. high voltage having a variable voltage value coupled in series thereto, the series combination coupled to said additional corona discharge electrodes and said collector electrodes.

9. An electric dust collector apparatus as defined in claim 1 and further including a variable, periodically varying, high voltage source for providing a periodically varying high voltage, whose peak period is variable, and means for coupling said last named source to said corona discharge electrodes and said river electrodes.

10. An electric dust collector apparatus as defined in claim 1 and further including a variable D.C. high voltage source having a variable voltage and a variable high voltage source for providing a periodically varying high voltage, whose peak period is variable, coupled in series with said variable D.C. high voltage source and means coupling said corona discharge and driver electrodes to the series coupled sources.

11. An electric dust collector apparatus comprising an inlet port for dust-containing gas disposed at one end of a duct forming a main body of said apparatus and an outlet port for clean gas disposed at the other end of said duct; a plurality of channel-shaped collector electrodes disposed at an equal interval and in parallel to each other along a plane transverse of a gas flow within said duct with their openings directed to an upstream side; a plurality of channel-shaped driver electrodes disposed upstream of said collector electrodes in a staggered relationship to said collector electrodes with their openings directed to a downstream side; a D.C. high voltage source coupled between said driver electrodes and said collector electrodes; a plurality of corona discharge electrodes disposed midway between adjacent ones of said driver electrodes and facing openings of said collector electrodes; and a variable high voltage source coupled between said corona discharge electrodes and said driver electrodes.

* * * * *

UNITED STATES PATENT AND TRADEMARK OFFICE

CERTIFICATE OF CORRECTION

PATENT NO. : 3,985,524

DATED : October 12, 1976

INVENTOR(S) : Senichi Masuda

It is certified that error appears in the above-identified patent and that said Letters Patent are hereby corrected as shown below:

Column 1, Line 17:
"accummulated" should be --- accumulated ---.
Column 4, Line 57:
"place" should be --- plane ---.
Column 4, Line 58:
"paosition" should be --- position ---.
Column 5, Line 7:
"supperposed" should be --- superposed ---.
Column 6, Line 21:
"sem-coductor" should be --- semiconductor ---.
Column 6, Lines 21 and 22:
"examm-ple" should be --- example ---.
Column 6, Line 38:
"dusut" should be --- dust ---.
Column 6, Line 50:
"vartically" should be --- vertically ---.
Column 7, Line 45:
"rod" should be --- rods ---.
Column 7, Line 53:
"voltae" should be --- voltage ---.
Column 8, Line 30:
After "flows" insert --- have ---.
Column 9, Line 59:
"an" should be --- and ---.

Signed and Sealed this

First Day of March 1977

[SEAL]

*Attest:*

RUTH C. MASON
*Attesting Officer*

C. MARSHALL DANN
*Commissioner of Patents and Trademarks*